US010001728B2

(12) United States Patent
Harada et al.

(10) Patent No.: US 10,001,728 B2
(45) Date of Patent: Jun. 19, 2018

(54) DEVELOPING DEVICE AND IMAGE FORMING APPARATUS HAVING A COLLECTION CONTAINER WITH A SWING PORTION

(71) Applicant: KYOCERA Document Solutions Inc., Osaka (JP)

(72) Inventors: Yuzo Harada, Osaka (JP); Yoshifumi Okauchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/612,322

(22) Filed: Jun. 2, 2017

(65) Prior Publication Data

US 2017/0357187 A1 Dec. 14, 2017

(30) Foreign Application Priority Data

Jun. 13, 2016 (JP) ..... 2016-117088

(51) Int. Cl.
*G03G 15/095* (2006.01)
*G03G 15/08* (2006.01)
*G03G 21/10* (2006.01)

(52) U.S. Cl.
CPC ..... *G03G 15/095* (2013.01); *G03G 15/0812* (2013.01); *G03G 21/10* (2013.01)

(58) Field of Classification Search
CPC ..... G03G 15/095
USPC ..... 399/260
See application file for complete search history.

(56) References Cited

U.S. PATENT DOCUMENTS

2011/0229184 A1* 9/2011 Kashimoto ..... G03G 15/0896 399/92
2012/0201575 A1 8/2012 Kashimoto et al. ..... 399/272

FOREIGN PATENT DOCUMENTS

JP 2012-208469 A 10/2012

* cited by examiner

*Primary Examiner* — Walter L Lindsay, Jr.
*Assistant Examiner* — Philip Marcus T Fadul
(74) *Attorney, Agent, or Firm* — Stein IP, LLC

(57) ABSTRACT

A developer container of a developing device has a toner collection portion having a collection container, a toner receiving member, a stopping member, and a toner collection passage. The collection container is arranged under a developing roller, extends along the axial direction of the rotary shaft of the developing roller, and has an opening open upward to face the developing roller. The toner receiving member is supported on the collection container, and has a swing portion protruding inward from an inner surface of the collection container and receiving toner that falls from the developing roller. The stopping member is supported on the collection container, and prevents, by the swing portion making contact with the stopping member from below, the swing portion from being displaced upward. The toner collection passage is arranged in a bottom part of the collection container, and communicates with the interior of the developer container.

4 Claims, 5 Drawing Sheets

DEVELOPING DEVICE AND IMAGE FORMING APPARATUS HAVING A COLLECTION CONTAINER WITH A SWING PORTION

INCORPORATION BY REFERENCE

This application is based upon and claims the benefit of priority from the corresponding Japanese Patent Application No. 2016-117088 filed on Jun. 13, 2016, the entire contents of which are incorporated herein by reference.

BACKGROUND

The present disclosure relates to a developing device and an image forming apparatus.

Widely used image forming apparatuses exploiting electrophotography, such as copiers and printers, form an electrostatic latent image on the surface of a photosensitive drum as an image carrying member, and develop the electrostatic latent image by using a developing device to thereby form a toner image on a sheet. Examples of methods for developing images include a method that uses two-component developer containing magnetic carrier and toner, and uses a toner feeding roller carrying the developer and a developing roller carrying toner alone.

In the developing device, in a region where the developing roller and the toner feeding roller face each other, only toner moves onto the developing roller via a magnetic brush formed on the surface of the toner feeding roller. At this time, the magnetic brush may sometimes separate toner left unused during development from the developing roller. This makes it more likely for the toner to float in the region where the developing roller and the toner supply roller face each other, and if the floating toner accumulates and collects, it may have an adverse effect on image quality.

There is known an example of a developing device proposed as a solution for such a problem. This conventional developing device includes a toner receiving member which receives the toner that falls from the developing roller, and a vibration generating means which vibrates the toner receiving member. In this developing device, by vibrating the toner receiving member, it is possible to prevent accumulation of toner that falls, without being used in development, from the developing roller.

SUMMARY

According to one aspect of the present disclosure, a developing device includes a developing roller, a toner feeding roller, a regulating blade, and a casing. The developing roller is arranged opposite an image carrying member on which an electrostatic image is formed, and feeds toner to the image carrying member in a region where the developing roller and the image carrying member face each other. The toner feeding roller is arranged opposite the developing roller, and feeds toner to the developing roller in a region where the toner feeding roller and the developing roller face each other. The regulating blade is arranged opposite the toner feeding roller across a predetermined interval. The casing has arranged in it the developing roller, the toner feeding roller, and the regulating blade, and stores toner to be fed to the image carrying member. The casing has a toner collection portion including a collection container, a toner receiving member, a stopping member, and a toner collection passage. The collection container is arranged under the developing roller and extends along the axial direction of the rotary shaft of the developing roller. The collection container has an opening open upward so as to face the developing roller. The toner receiving member is supported on the collection container, and has a swing portion which protrudes inward from an inner surface of the collection container and which receives toner that falls from the developing roller. The swing portion is swingable. The stopping member is supported on the collection container, and prevents, as a result of the swing portion of the toner receiving member making contact with the stopping member from below, the swing portion from being displaced upward. The toner collection passage is arranged in a bottom part of the collection container, and communicates with the interior of the casing.

DETAILED DESCRIPTION

Embodiments of the present disclosure will be described below with reference to the accompanying drawings. The present disclosure is not limited to what is specifically mentioned below.

First Embodiment

Figure 1:
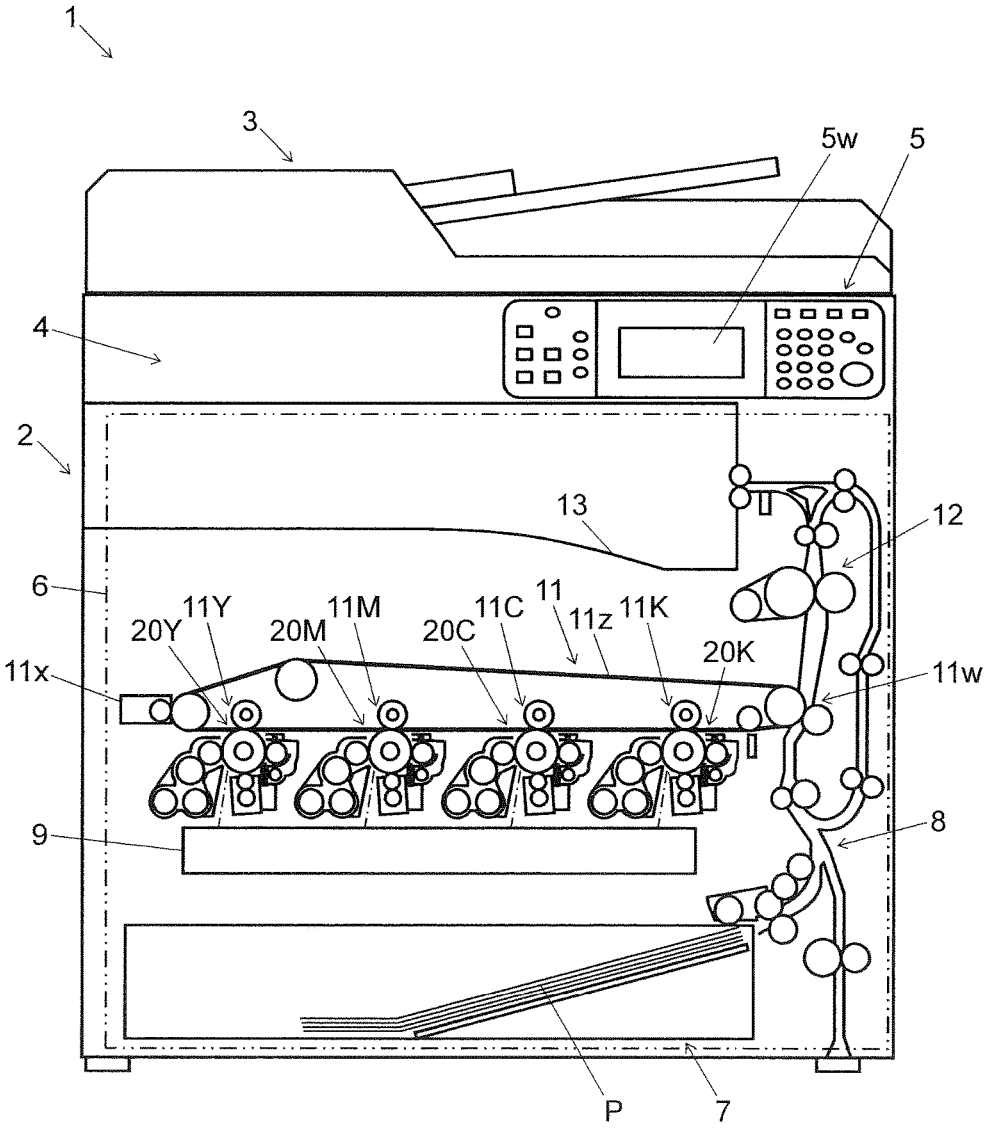
FIG. 1 is a sectional view showing a schematic configuration of an image forming apparatus according to a first embodiment of the present disclosure.
Figure 2:
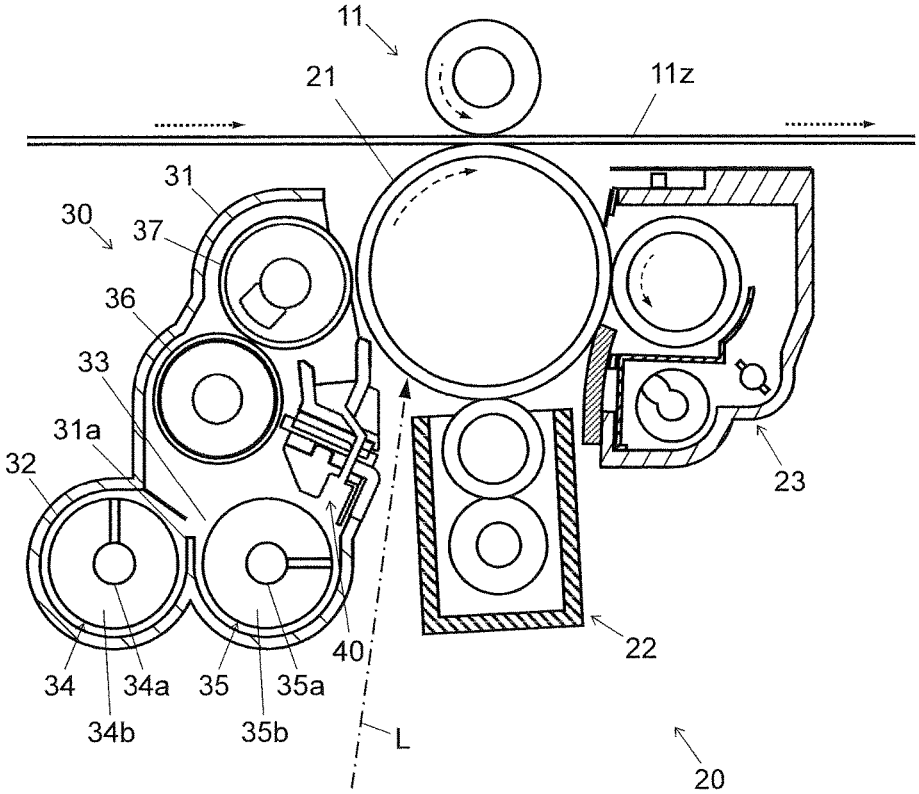
FIG. 2 is a sectional view of an image forming portion of the image forming apparatus according to the first embodiment of the present disclosure.

First, a description will be given of a schematic configuration of an image forming apparatus according to a first embodiment of the present disclosure with reference to FIG. 1 and FIG. 2. FIG. 1 is an example of a sectional view showing the schematic configuration of the image forming apparatus. FIG. 2 is a sectional view showing a configuration of an image forming portion of the image forming apparatus. The image forming apparatus 1 is what is called a multifunction peripheral, which is equipped with functions such as a printing (copying) function, a scanning (image reading) function, and a facsimile sending function. The image forming apparatus 1 is a multi-color image forming apparatus, and uses an intermediate transfer belt to transfer a toner image onto a sheet.

As illustrated in FIG. 1, the image forming apparatus 1 includes a body 2, an auto document feeder 3 on top of the body 2, and an image reader 4 under the auto document feeder 3 in the body 2. The image reader 4 reads images on documents stacked on the auto document feeder 3 or an image on a document placed on an unillustrated contact glass on top of, the image reader 4.

In an upper part of the body 2, on a front side of the image reader 4, an operation panel 5 is provided. The operation panel 5 accepts instructions that the user inputs to make the image forming apparatus 1 perform a print (copy) job, a scan (image-read) job, a facsimile-transmission job, and the like. The operation panel 5 displays, for example, the status of the apparatus, precautions, error messages, and the like on a display portion 5*w*.

The image forming apparatus 1 further includes a print portion 6 for performing printing jobs. The print portion 6 is arranged under the image reader 4 in the body 2. The print portion 6 includes a sheet feed portion 7, a sheet conveying portion 8, an exposure portion 9, an image forming portion 20, a transfer portion 11, and a fixing portion 12.

The sheet feed portion 7 accommodates a plurality of sheets P, and feeds them out during printing in a one-by-one separate manner. The sheet conveying portion 8 conveys the sheets P fed out from the sheet feed portion 7 to a secondary transfer portion 11*w* and the fixing portion 12, and discharges the sheets P that have undergone fixing onto a sheet discharge portion 13. The exposure portion 9 radiates toward the image forming portion 20 laser light L controlled based on image data.

The image forming portion 20 is provided with four image forming portions, namely, a yellow image forming portion 20Y, a magenta image forming portion 20M, a cyan image forming portion 20C, and a black image forming portion 20K. In the following descriptions, the color identification symbols "Y", "M", "C", and "K" will be omitted unless necessary for specific identification.

The image forming portion 20 includes, as shown in FIG. 2, a photosensitive drum 21 as an image carrier, a charging portion 22, a developing device 30, and a drum cleaning portion 23. The photosensitive drum 21 is supported to be rotatable in a predetermined direction (in the clockwise direction in FIG. 2), and the charging portion 22, the developing device 30 and the drum cleaning portion 23 are arranged around the photosensitive drum 21 along the rotation direction of the photosensitive drum 21. Here, primary transfer portions 11Y, 11M, 11C, and 11K are arranged between the developing device 30 and the drum cleaning portion 23.

The transfer portion 11 includes an intermediate transfer belt 11*z*, the primary transfer portions 11Y, 11M, 11C, and 11K, the secondary transfer portion 11*w*, and an intermediate transfer cleaning portion 11*x*. The four image forming portions 20 are aligned from an upstream side toward a downstream side of the intermediate transfer belt 11*z* in a rotation direction of the intermediate transfer belt 11*z*, in a so-called tandem-type arrangement.

The charging portion 22 electrostatically charges the surface of the photosensitive drum 21 to a predetermined potential, for example, by a charging roller. Then, by the laser light L emitted from the exposure portion 9, an electrostatic latent image based on a document image is formed on the surface of the photosensitive drum 21. The developing device 30 feeds toner to the electrostatic latent image and develops it, thereby forming a toner image.

Toner images of the different colors are primarily transferred to the surface of the intermediate transfer belt 11*z*, respectively, in the primary transfer portions 11Y, 11M, 11C, and 11K arranged over the image forming portions 20Y, 20M, 20C, 20K. Here, as the intermediate transfer belt 11*z* rotates, the toner images of the image forming portions 20 are sequentially transferred, with predetermined timing, to the intermediate transfer belt 11*z* so that the toner images of four colors, namely yellow, magenta, cyan, and black are superimposed on one another, thereby forming a color toner image on the surface of the intermediate belt 11*z*. After primary transfer, the drum cleaning portion 23 cleans the surface of the photosensitive drum 21 by removing unused toner from it.

The color toner image on the surface of the intermediate transfer belt 11*z* is transferred to a sheet P conveyed concurrently by the sheet conveying portion 8 at a secondary transfer nip formed in the secondary transfer portion 11*w*. After secondary transfer, the intermediate transfer cleaning portion 11*x* cleans the surface of the intermediate transfer belt 11*z* by removing unused toner from it.

The fixing portion 12 heats and presses the sheet P having the toner image transferred to it, and thereby fixes the toner image to the sheet P. In this way, the print portion 6 prints a document image on a sheet P.

Now, the overall configuration of the developing device 30 in the image forming portion 20 will be described with reference to FIG. 2. The developing devices 30 for the different colors all have basically the same structure, and thus the suffixes distinguishing the different colors will be omitted from illustration.

As shown in FIG. 2, the developing device 30 has a developer container 31, a stirring chamber 32, a feeding chamber 33, a stirring/conveying screw 34, a feeding/conveying screw 35, a toner feeding roller 36, a developing roller 37, a regulating blade 38, and a toner collection portion 40.

The developer container 31 is a casing which stores two-component developer containing toner to be fed to the photosensitive drum 21 which is an image carrying member. In the following description, two-component developer is occasionally referred to simply as "developer". The developer container 31 is, for example, formed as a synthetic resin molding. The developer container 31 has a shape elongated in the axial direction of the photosensitive drum 21, and is arranged with its longitudinal direction aligned horizontally.

The developer container 31 includes, in a bottom part inside it, the stirring chamber 32 and the feeding chamber 33 partitioned by a partition wall 31*a*. The feeding chamber 33 is arranged below a region where the developing roller 37 is arranged. The stirring chamber 32 is arranged in a region farther away from the developing roller 37 than the feeding chamber 33.

In the stirring chamber 32, an unillustrated toner supply port and a toner concentration sensor are arranged. Toner is supplied based on the result of detection by the toner concentration sensor via the toner supply port to the stirring chamber 32. As the toner concentration sensor, for example, a magnetic permeability sensor is used which detects the magnetic permeability of two-component developer containing toner and magnetic carrier in the developer container 31.

The stirring/conveying screw 34 is arranged in the stirring chamber 32. The stirring/conveying screw 34 is composed of a conveying blade 34*b* spirally extending, along the axial direction, on the circumferential surface of a rotary shaft 34*a* arranged between opposite ends in the axial direction. The stirring/conveying screw 34 is supported on the developer container 31 so as to be rotatable about its axis extending in the horizontal direction. The stirring/conveying screw 34 rotates about its axis to convey developer, while stirring it, along the axial direction of its rotary shaft.

The feeding/conveying screw 35 is arranged in the feeding chamber 33. The feeding/conveying screw 35 is composed of a conveying blade 35*b* spirally extending, along the axial direction, on the circumferential surface of a rotary shaft 35*a* arranged between opposite ends in the axial direction. The feeding/conveying screw 35 is supported on the developer container 31 so as to be rotatable about its axis extending in the horizontal direction. The feeding/conveying screw 35 rotates about its axis to convey developer, while stirring it, along the axial direction of its rotary shaft.

By the rotation of the stirring/conveying screw 34 and the feeding/conveying screw 35, developer circulates between the stirring chamber 32 and the feeding chamber 33 via an unillustrated communication passage provided on opposite end parts of the partition wall 31*a* in the axial direction. In the stirring chamber 32 and the feeding chamber 33, the toner (positively charged toner) supplied from outside is mixed and stirred with magnetic carrier, and is electrostatically charged.

The toner feeding roller 36 is arranged in the developer container 31, above the feeding/conveying screw 35. The toner feeding roller 36 is supported on the developer container 31 so as to be rotatable about its axis extending in the horizontal direction. The toner feeding roller 36 has a non-magnetic rotary sleeve which rotates in the counter-clockwise direction in FIG. 2, and a fixed magnet member which has a plurality of magnetic poles housed in the rotary sleeve. The toner feeding roller 36 is arranged opposite the developing roller 37, and feeds toner to the developing roller 37 in the region where the toner feeding roller 36 and the developing roller 37 face each other.

The developing roller 37 is arranged in the developer container 31, above the toner feeding roller 36. The circumferential surface of the developing roller 37 is arranged opposite the circumferential surface of the toner feeding roller 36 across a predetermined interval. The developing roller 37 is supported on the developer container 31 so as to be rotatable about its axis extending in the horizontal direction. The developing roller 37 has a cylindrical developing sleeve which rotates in the counter-clockwise direction in FIG. 2, and a developing roller-side magnetic pole fixed in the developing sleeve. The developing roller-side magnetic pole has the opposite polarity to that of the magnetic pole (main pole) of a fixed magnet member, the developing roller-side magnetic pole facing the fixed magnet member. The developing roller 37 is arranged opposite the photosensitive drum 21, and feeds toner to the photosensitive drum 21 in the region where the developing roller 37 and the photosensitive drum 21 face each other.

The regulating blade 38 is arranged close to the toner feeding roller 36 such that its tip end faces the surface of the toner feeding roller 36. The regulating blade 38 is arranged, with respect to the rotation direction of the toner feeding roller 36, on the upstream side of the region where the toner feeding roller 36 and the developing roller 37 face each other. The regulating blade 38 is arranged with a predetermined interval left between its tip end and the surface of the toner feeding roller 36.

To the developing roller 37, a DC voltage (hereinafter referred to as Vslv(DC)) and an AC voltage (hereinafter referred to as Vslv(AC)) are applied. To the toner feeding roller 36, a DC voltage (hereinafter referred to as Vmag (DC)) and an AC voltage (hereinafter referred to as Vmag (AC)) are applied. These AC and DC voltages are applied from a developing bias power source via a bias control circuit (neither of these are illustrated) to the developing roller 37 and the toner feeding roller 36.

Developer is stirred to circulate, while being electrostatically charged, through the stirring chamber 32 and the feeding chamber 33 by the stirring/conveying screw 34 and the feeding/conveying screw 35, and is conveyed to the toner feeding roller 36 by the feeding/conveying screw 35. On the surface of the toner feeding roller 36, an unillustrated magnetic brush is formed. The magnetic brush has its layer thickness regulated by the regulating blade 38, and then is conveyed to the region where the toner feeding roller 36 and the developing roller 37 face each other. Then, by the potential difference ΔV between the Vmag(DC) applied to the toner feeding roller 36 and the Vslv(DC) applied to the developing roller 37 and by a magnetic field, a layer of toner is formed on the developing roller 37.

The thickness of the layer of toner on the surface of the developing roller 37 varies with the resistance of developer, the difference in rotation speed between the toner feeding roller 36 and the developing roller 37, etc., but can be controlled by controlling the potential difference ΔV. Increasing the potential difference ΔV makes the layer of toner on the surface of the developing roller 37 thicker, and decreasing the potential difference ΔV makes the layer of toner thinner. A proper range of the potential difference ΔV during development is approximately from 100V to 350V.

The layer of toner formed on the surface of the developing roller 37 by making contact with the magnetic brush on the surface of the toner feeding roller 36 is conveyed to the region where the photosensitive drum 21 and the developing roller 37 face each other by the rotation of the developing roller 37. Vslv(DC) and Vslv(AC) are applied to the developing roller 37, and thus, due to the potential difference between the developing roller 37 and the photosensitive drum 21, toner flies to the surface of the photosensitive drum 21 so that an electrostatic latent image on it is developed.

Toner left unused during development is conveyed once again to the region where the developing roller 37 and the toner feeding roller 36 face each other. By the magnetic brush, the toner left unused during development can sometimes be removed from the developing roller 37 and fall into the developer container 31.

To cope with that, the toner collection portion 40 is arranged under the developing roller 37, along the axial direction of the rotary shaft of the developing roller 37. The toner collection portion 40 collects toner that falls, without being used in development, from the developing roller 37, and guides the collected toner into the feeding chamber 33, which is the developer container 31.

Figure 3:
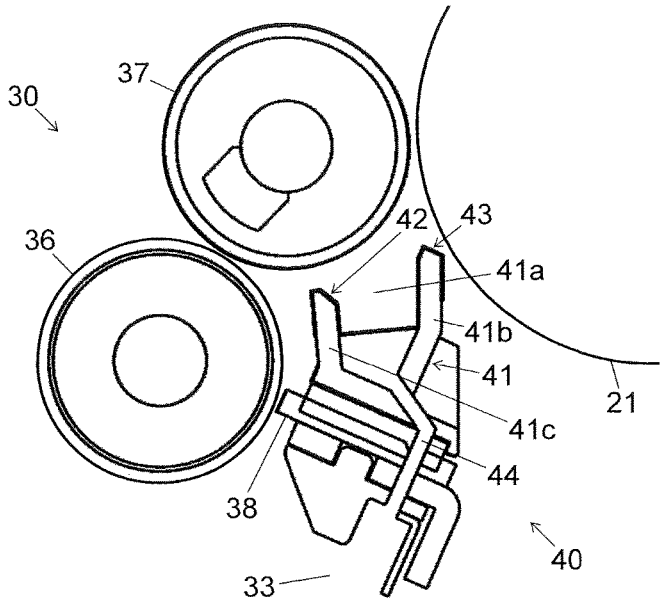
FIG. 3 is a partial sectional view of a developing device of the image forming apparatus according to the first embodiment of the present disclosure.
Figure 4:
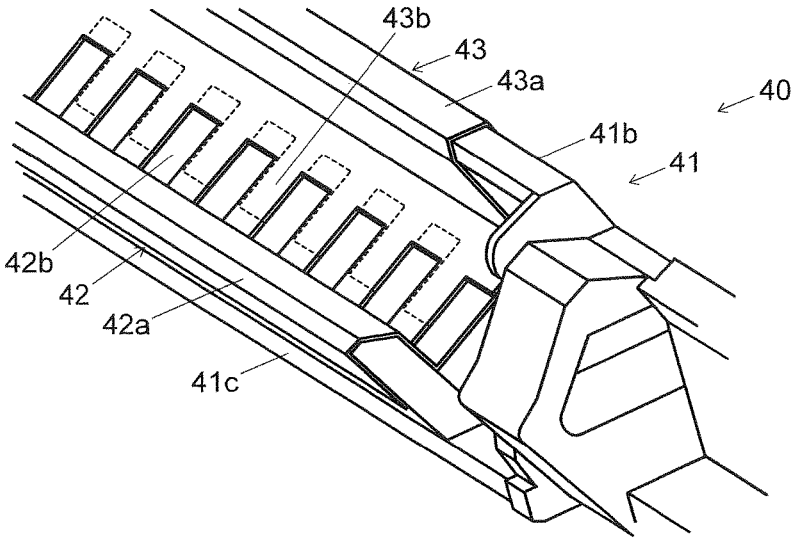
FIG. 4 is a partial perspective view of the developing device of the image forming apparatus according to the first embodiment of the present disclosure.
Figure 5:
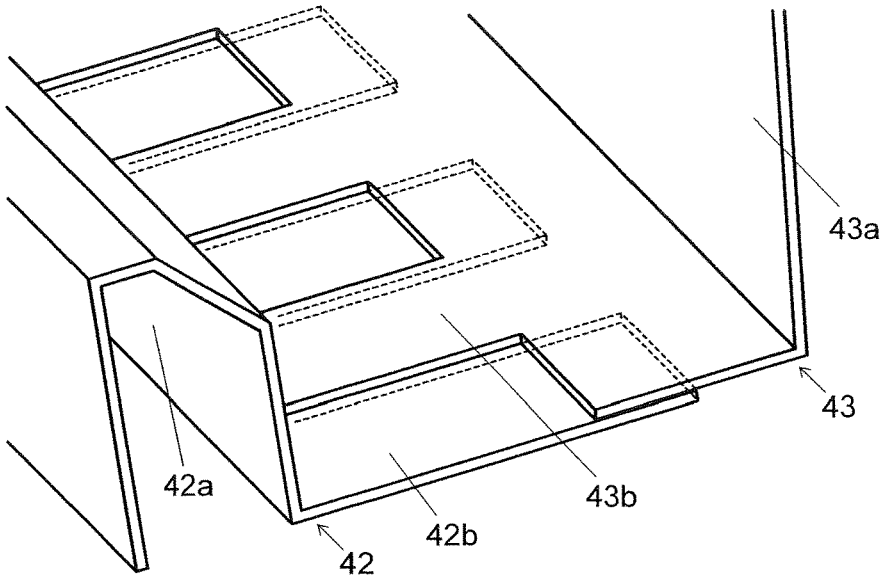
FIG. 5 is a partial perspective view of a toner receiving member and a stopping member of a toner collection portion of the developing device according to the first embodiment of the present disclosure.
Figure 6:
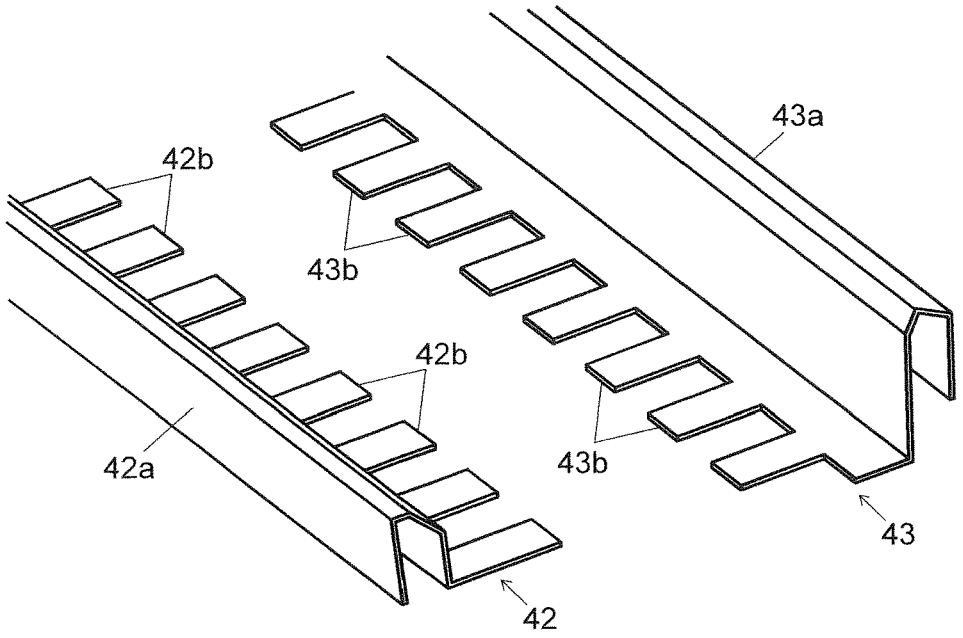
FIG. 6 is a partial exploded perspective view of the toner receiver member and the stopping member of the toner collection portion of the developing device according to the first embodiment of the present disclosure.

Now, the configuration of the toner collection portion 40 will be described in detail with reference to FIGS. 3 to 6. FIGS. 3 and 4 are a partial sectional view and a partial perspective view of the developing device 30. FIGS. 5 and 6 are a partial perspective view and a partial exploded perspective view of a toner receiving member and a stopping member of the toner collection portion 40.

As shown in FIGS. 3 and 4, the toner collection portion 40 includes a collection container 41, a toner receiving member 42, a stopping member 43, and a toner collection passage 44.

The collection container 41 is arranged under the developing roller 37, and extends along the axial direction of the rotary shaft of the developing roller 37. The collection container 41 is formed in the shape of a box having an opening 41*a* open upward so as to face the developing roller 37. The collection container 41 has side walls 41*b* and 41*c* arranged opposite each other across the interior space of the collection container 41 in a direction crossing the axial direction of the rotary shaft of the developing roller 37. The side wall 41*b* is arranged closer to the photosensitive drum 21 than the side wall 41*c* is. The side wall 41*c* is arranged away from the photosensitive drum 21 across the side wall 41*b* and the interior space of the collection container 41.

The toner receiving member 42 is, for example, a flexible sheet-form member, and includes a locking portion 42*a* and a swing portion 42*b*. The locking portion 42*a* is formed by being bent into a substantially U-shape, and is supported by being hooked on the side wall 41*c* of the collection container 41 from above. The swing portion 42*b* is connected to one end part of the locking portion 42*a* extending along the axial direction of the rotary shaft of the developing roller 37 in the collection container 41. The swing portion 42*b* is formed in the shape of a comb protruding inward of the collection container 41 from the inner surface of the side wall 41*c* of the collection container 41. The toner receiving member 42 has the swing portion 42*b* configured swingable in the up/down direction, and receives toner that falls from the developing roller 37.

The stopping member 43 is, for example, a sheet-form member having higher rigidity than that of the toner receiving member 42, and includes a locking portion 43*a* and a stopping portion 43*b*. The locking portion 43*a* is formed by being bent into a substantially U-shape, and is supported by being hooked on the side wall 41*b* of the collection container 41 from above. The stopping portion 43*b* is connected to one end part of the locking portion 43*a* extending along the axial direction of the rotary shaft of the developing roller 37 in the collection container 41. The stopping portion 43*b* is formed in the shape of a comb protruding inward of the collection container 41 from the inner surface of the side wall 41*b* of the collection container 41. The stopping member 43 prevents, as a result of the swing portion 42*b* of the toner receiving member 42 making contact with the stopping portion 43*b* from below, the swing portion 42*b* from being displaced upward.

The toner receiving member 42 and the stopping member 43 have their respective comb-shaped parts arranged alternately along the axial direction of the rotary shaft of the developing roller 37.

The toner collection passage 44 is arranged in a bottom part of the collection container 41. The toner collection passage 44 is formed substantially in the shape of a pipe to communicate with the feeding chamber 33 which is the interior of the collection container 41. A plurality of toner collection passages 44 are aligned along the axial direction of the rotary shaft of the developing roller 37. Through the toner collection passage 44, toner collected in the collection container 41 is conveyed to the feeding chamber 33.

With the configuration according to the above-described embodiment, toner that falls from the developing roller 37 without being used in development is guided via the opening 41*a* in the toner collection portion 40 into the collection container 41, and is received by the swing portion 42*b* of the toner receiving member 42. Owing to the swing portion 42*b* being configured swingable in the up/down direction, by the action of gravity, toner can be guided to a bottom part of the collection container 41 and be conveyed to the toner collection passage 44. Also, owing to the stopping member 43 preventing the swing portion 42*b* of the toner receiving member 42 from being displaced upward, toner collected in the toner collection portion 40 can be prevented from attaching once again to the developing roller 37. Thus, it is possible, while achieving space saving and cost reduction of the developing device 30, to effectively prevent accumulation of toner that falls, without being used in development, from the developing roller 37.

The toner receiving member 42 and the stopping member 43 are formed in the shape of combs and arranged opposite each other, and have their respective comb-shaped parts arranged alternately along the axial direction of the rotary shaft of the developing roller 37; this makes it possible to divide the swing portion 42*b* of the toner receiving member 42 into a plurality of parts along the axial direction of the rotary shaft of the developing roller 37. Thus, it is possible to swing the swing portion 42*b* downward with toner having a minimum load. This helps improve toner collection performance of the toner collection portion 40.

The toner receiving member 42 is a flexible sheet-form member, and this makes it possible to easily swing the swing portion 42*b*. Thus, it is possible to obtain the toner receiving member 42 with a simple configuration, and also to enhance toner collection performance.

The stopping member 43 is a sheet-form member having higher rigidity than that of the toner receiving member 42, and this makes it possible to obtain the stopping member 43 with a simple configuration.

Second Embodiment

Figure 7:
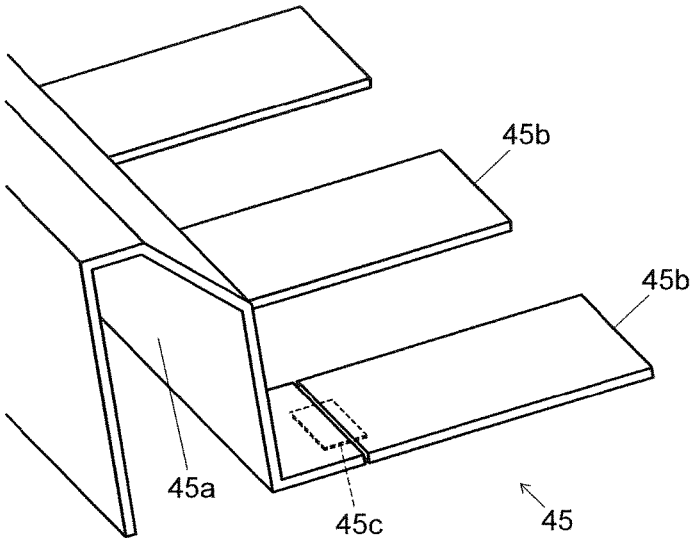
FIG. 7 is a partial perspective view of a toner receiving member of a toner collection portion of a developing device according to a second embodiment of the present disclosure.

Next, a developing device according to a second embodiment of the present disclosure will be described with reference to FIG. 7. FIG. 7 is a partial perspective view of a toner receiving member of a toner collection portion of the developing device. The basic structure of this embodiment is similar to that of the first embodiment described above; thus such components as find their counterparts in the first embodiment are identified by the same reference signs or the same names, and overlapping description may not be repeated.

In the developing device 30 according to the second embodiment, the toner collection portion 40 is provided with a toner receiving member 45 as shown in FIG. 7. The toner receiving member 45 is, for example, a sheet-form member, and includes a locking portion 45*a*, a swing portion 45*b*, and a hinge portion 45*c*.

The hinge portion 45*c* couples the locking portion 45*a* and the swing portion 45*b* together. The hinge portion 45*c* includes, for example, a flat spring or a torsion spring, and supports the swing portion 45*b* swingably in the up/down direction.

Also with this configuration, by the action of gravity, toner can be guided to a bottom part of the collection container 41, and be conveyed to the toner collection passage 44. Thus, it is possible, while achieving space saving and cost reduction of the developing device 30, to effectively prevent accumulation of toner that falls, without being used in development, from the developing roller 37.

Third Embodiment

Figure 8:
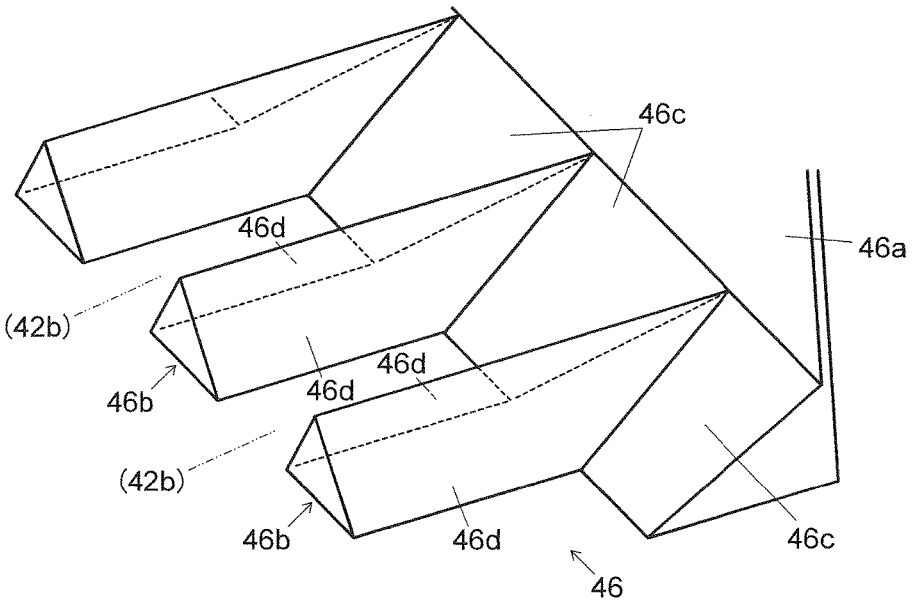
FIG. 8 is a partial perspective view of a stopping member of a toner collection portion of a developing device according to a third embodiment of the present disclosure.

Next, a developing device according to a third embodiment of the present disclosure will be described with reference to FIG. 8. FIG. 8 is a partial perspective view of a stopping member of a toner collection portion in the developing device. The basic configuration according to this embodiment is similar to that of the first embodiment described previously; thus such components as find their counterparts in the first embodiment are identified by the same reference signs or the same names, and overlapping description may not be repeated.

In the developing device 30 according to the third embodiment, the toner collection portion 40 is provided with a stopping member 46 as shown in FIG. 8. The stopping member 46 includes a locking portion 46*a* and a stopping portion 46*b*. The locking portion 46*b* has a plurality of inclined surfaces 46*c* and 46*d* extending downward from above while inclining in a direction approaching the swing portion 42*b* (unillustrated in FIG. 8) of the toner receiving member 42 formed in the shape of a comb.

The inclined surface 46*c* is arranged next to a lower part of the locking portion 46*a* in the collection container 41, that is, close to the inner surface of a side wall of the collection container 41. The inclined surface 46*c* extends downward in a direction approaching the swing portion 42*b* away from the side wall of the collection container 41.

The inclined surface 46*d* is arranged on the comb-shaped part of the stopping portion 46*b*. The inclined surface 46*d* is arranged between adjacent swing portions 42*b* along the axial direction of the rotary shaft of the developing roller 37. The inclined surface 46*d* extends downward, while inclining along the axial direction of the rotary shaft of the developing roller 37, in a direction approaching the swing portion 42*b*.

With this configuration, it is possible to prevent accumulation of toner on the stopping portion 46*b*, and this makes it easy to guide toner that falls from the developing roller 37 to the top surface of the swing portion 42*b*. Thus, it is possible to efficiently collect toner that falls from the developing roller 37, and to improve the action of preventing accumulation of toner.

While some embodiments of the present disclosure have been described above, they are in no way meant to limit the scope of the present disclosure, which thus allows for many modifications and variations within the spirit of the present invention.

For example, the toner receiving member and the stopping member mentioned in the first, second, and third embodiments described above can be used in combination as necessary. For another example, the toner receiving member and the stopping member may have their arrangement positions switched with each other.

What is claimed is:

1. A developing device comprising:

a developing roller arranged opposite an image carrying member on which an electrostatic image is formed, the developing roller feeding toner to the image carrying member in a region where the developing roller and the image carrying member face each other;

a toner feeding roller arranged opposite the developing roller, the toner feeding roller feeding toner to the developing roller in a region where the toner feeding roller and the developing roller face each other;

a regulating blade arranged opposite the toner feeding roller across a predetermined interval; and a casing in which the developing roller, the toner feeding roller, and the regulating blade are arranged, the casing storing toner to be fed to the image carrying member, wherein the casing has a toner collection portion including:

a collection container which is arranged under the developing roller and which extends along an axial direction of a rotary shaft of the developing roller, the collection container having an opening open upward so as to face the developing roller;

a toner receiving member supported on the collection container, the toner receiving member having a swing portion which protrudes inward from an inner surface of the collection container and which receives toner that falls from the developing roller, the swing portion being swingable;

a stopping member supported on the collection container, the stopping member preventing, as a result of the swing portion of the toner receiving member making contact with the stopping member from below, the swing portion from being displaced upward; and a toner collection passage arranged in a bottom part of the collection container, the toner collection passage communicating with an interior of the casing, wherein the toner receiving member and the stopping member are arranged opposite each other in a shape of combs protruding inward from the inner surface of the collection container, the toner receiving member and the stopping member having respective comb-shaped parts thereof arranged alternately along the axial direction of the rotary shaft of the developing roller, the toner receiving member is a flexible sheet-form member, and the stopping member is a sheet-form member having higher rigidity than rigidity of the toner receiving member.

2. The developing device of claim 1, wherein the toner receiving member includes a hinge portion which supports the swing portion swingably in an up/down direction.

3. The developing device of claim 1, wherein the stopping member has a plurality of inclined surfaces extending downward while inclining in a direction approaching the swing portion of the toner receiving member.

4. An image forming apparatus comprising the developing device of claim 1.

* * * * *